US010204470B1

(12) United States Patent
Chinn

(10) Patent No.: US 10,204,470 B1
(45) Date of Patent: Feb. 12, 2019

(54) CASINO WAGERING GAME WITH PLAYER SELECTED CONDITIONS

(71) Applicant: R L Chinn, Las Vegas, NV (US)

(72) Inventor: R L Chinn, Las Vegas, NV (US)

( * ) Notice: Subject to any disclaimer, the term of this patent is extended or adjusted under 35 U.S.C. 154(b) by 126 days.

(21) Appl. No.: 14/744,030

(22) Filed: Jun. 19, 2015

Related U.S. Application Data

(60) Provisional application No. 62/014,132, filed on Jun. 19, 2014.

(51) Int. Cl.
*A63F 9/24* (2006.01)
*G07F 17/32* (2006.01)

(52) U.S. Cl.
CPC ..... *G07F 17/3204* (2013.01); *A63F 9/24* (2013.01); *G07F 17/3267* (2013.01); *G07F 17/3288* (2013.01); *A63F 2009/2401* (2013.01)

(58) Field of Classification Search
CPC ..... G07F 17/3202; G07F 17/3204; A63F 9/04
See application file for complete search history.

(56) References Cited

U.S. PATENT DOCUMENTS

| | | | | |
|---|---|---|---|---|
| 8,152,612 | B1 * | 4/2012 | Poisson | G07F 17/32 463/4 |
| 8,651,869 | B1 | 2/2014 | Lassalle | |
| 2008/0012219 | A1 * | 1/2008 | Abrahamson | A63F 3/00157 273/146 |
| 2008/0194307 | A1 * | 8/2008 | Sanger | G07F 17/3276 463/4 |
| 2014/0113701 | A1 * | 4/2014 | Weiss | G07F 17/3218 463/20 |
| 2014/0135101 | A1 * | 5/2014 | Abrahamson | G07F 17/3286 463/22 |

* cited by examiner

*Primary Examiner* — Steve Rowland
(74) *Attorney, Agent, or Firm* — Muskin and Farmer LLC

(57) ABSTRACT

A method, apparatus, and computer readable storage medium to implement a wagering method using at least one electronic random number generator which simulates dice. The method can simulate a game of "football" which is based purely on player decisions and random outcomes of the random number generator. Different sequences of the method can be initiated based on outcomes of the random number generator.

21 Claims, 7 Drawing Sheets

RECEIVE SCRIMMAGE LINE BET
100~
ROLL DICE (KICKOFF)
101~
LOSE
103^
102~
ROLL?
2 OR 3
5 OR 10
WIN
~104
104^
4,6-9,11-12
TURNOVER / LOSE
111^
107~
CHOOSE TURNOVER ROLL (6 OR 8)
WIN
105^
INCREASE DOWN
112^
PLAYER CAN LAY ODDS
108^
CONVERSION ROLL
106^
DOWN >4?
NO
~113
ROLL DICE
109^
YES
DOWN=1
114^
7
ROLL?
TURN-OVER ROLL
110~
ALL OTHERS

CASINO WAGERING GAME WITH PLAYER SELECTED CONDITIONS

CROSS REFERENCE TO RELATED APPLICATIONS

This application claims benefit to U.S. provisional application 62/014,132, which is incorporated by reference herein in its entirety.

BACKGROUND OF THE INVENTION

Field of the Invention

The present general inventive concept is directed to a method, apparatus, and computer readable storage medium directed to a wagering game that can be played electronically or using physical instruments.

Description of the Related Art

Many kinds of wagering games are known in the art. What is needed is a new kind of wagering game that players may find exciting.

SUMMARY OF THE INVENTION

It is an aspect of the present invention to provide an exciting wagering game.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
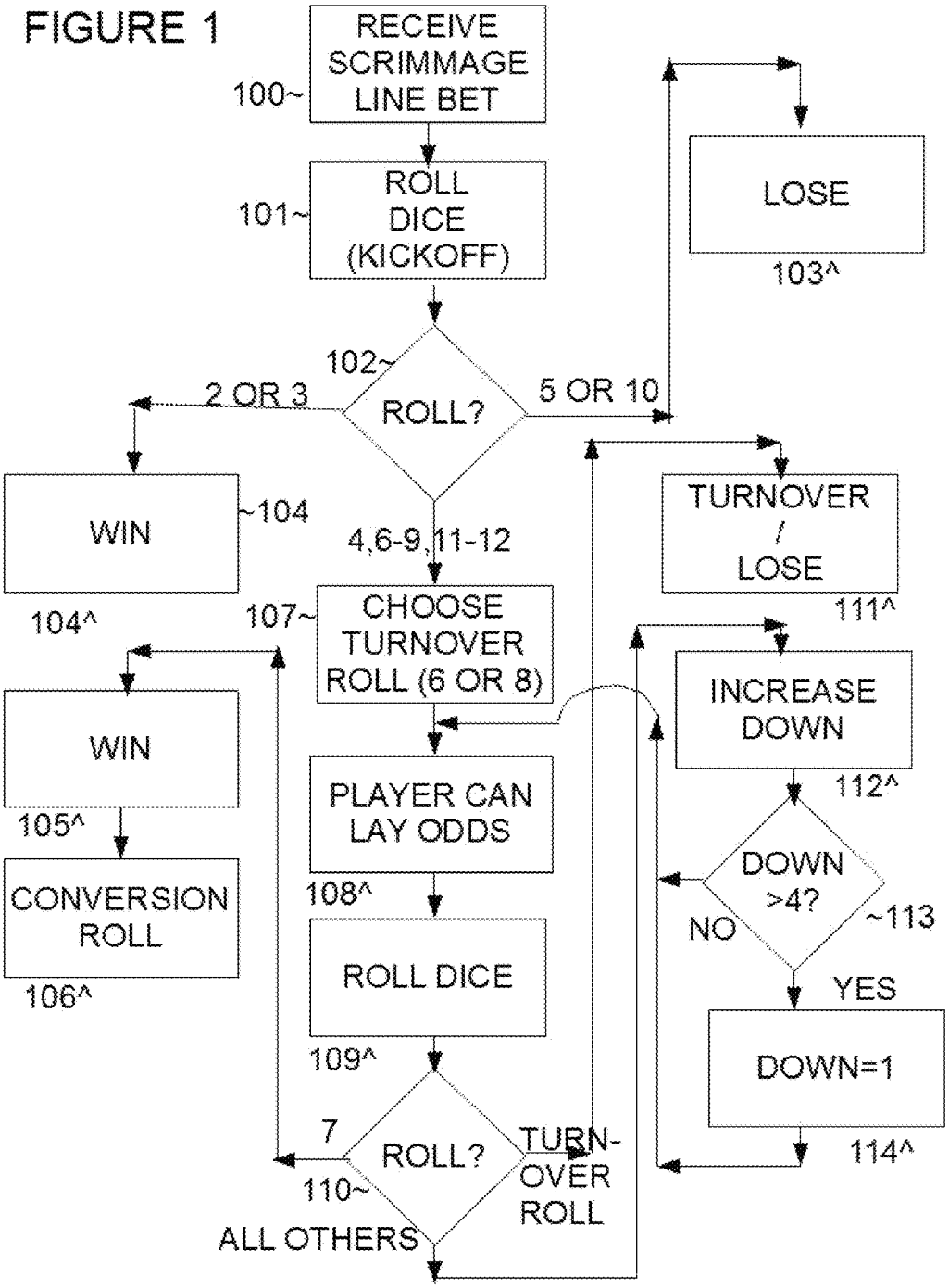
FIG. 1 is a flowchart illustrating an exemplary method for implementing a scrimmage line bet, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a wagering game which can use dice. The game can be considered to be a "football" version of craps. However, the game is not limited to using dice as the random number generator and other such random number generators can be used (e.g., wheel, electronic random number generator, etc.)

At the beginning of each round, one player will be selected to act as the shooter. To begin, the shooter must place a Scrimmage Line bet and First Down Bet. The shooter and any participating players may also optionally place bets throughout the course of the game as detailed below. Once all initial bets are placed, the shooter will begin to roll two standard six-sided dice. The game is divided into two different phases: the Kickoff roll, and all rolls following the Kickoff roll. The Kickoff roll is the very first roll made by the shooter. If there is no win or loss on the Kickoff, the shooter will select a turnover value of either 6 or 8. Each successive roll is referred to as $1^{st}$ down, $2^{nd}$ down, $3^{rd}$ down, $4^{th}$ down, $1^{st}$ down etc. The shooter continues to roll the dice until either a Touchdown or a Turnover is rolled. Table I below illustrated the special dice outcomes:

TABLE I

| | |
|---|---|
| 2 | Safety |
| 3 | Field Goal |
| 5 | 5-yard penalty |
| 10 | 10-yard penalty |
| 7 | Touchdown |
| 6 or 8 | Turnover |

There is no variable "point" as in craps, but rather 7 can be thought of as the "point". Also, either 6 or 8 can be thought of as the losing number. If a Touchdown is rolled before a Turnover, then the shooter will roll the Extra Point roll immediately afterward, which determines the payout of the Scrimmage Line bet as detailed below. After the Extra Point roll, the game will start over with the same shooter.

A scrimmage line bet is required of the shooter only and may optionally be placed by any other player. It must be placed before the Kickoff roll. During the Kickoff, if a Safety or Field Goal is rolled, then the Scrimmage Line bet wins and pays even money. If either a 5-yard or 10-yard penalty is rolled then the bet is lost. Otherwise, the bet remains unresolved, and play proceeds into the next round. After the Kickoff, if a Turnover is rolled, the Scrimmage Line bet is lost. If a Touchdown is rolled then the shooter will roll the Extra Point roll immediately afterward for a chance at increasing the payout for the Scrimmage Line bet. The Extra Point roll does not affect any other bets or game play. If a 7 is rolled on the Extra Point roll, the Scrimmage Line bet pays 7 to 5. Otherwise, it pays 1 to 1. After the Kickoff, on any down, players may also lay a free odds bet, which pays 5 to 6, if a Touchdown is rolled. The odds bet loses if a Turnover is rolled.

A defense bet is an optional bet that may be placed by any player prior to the initial dice roll. Once the Defense bet is placed it cannot be taken down. During the Kickoff roll, if a Safety or Field Goal is rolled then the bet is lost, if a 5-yard penalty is rolled then the bet pushes, and if a 10-yard penalty is rolled the bet wins and pays 3 to 2. After the Kickoff, if a Turnover is rolled before a Touchdown then the Defense bet wins and pays even money. If a Touchdown is rolled before a Turnover then the Defense bet is lost. After the Kickoff, on any down, players may lay a free odds bet, which pays 6 to 5, if a Turnover is rolled. The odds bet loses if a Touchdown is rolled.

A super bet (or superbet) is an optional bet that may be placed by any player prior to a new shooter making their initial roll. This wager pays if the shooter rolls at least three Touchdowns and three Extra Points before rolling a Turnover according to the paytable listed in Table I. Otherwise, this wager is lost when a Turnover is rolled. Three touchdowns and extra points rolled can pay 69 to 1, and 4 or more touchdowns and extra points rolled can pay 699 to 1.

A first down bet is required of the shooter and any player who places a Scrimmage Line bet. It may optionally be placed alone by any other player. If the shooter rolls four times in a row without getting a Touchdown or a Turnover after the Kickoff, the bet wins and pays 7 to 5. If a Touchdown occurs at any point, then the bet pushes. If a Turnover occurs at any point, then the bet is lost. The First Down bet cannot be lost on the Kickoff or Extra Point roll.

A Sideline Bet is an optional bet that can be made on any roll other than the Kickoff or Extra Point roll. On the first roll after the bet is made, a Safety wins and pays even money, and a Turnover results in the bet being lost. After the first roll, the bet now functions and pays exactly the same as all Scrimmage Line bets currently on the table. The player may also make a free odds bet which pays 5 to 6 for getting a Touchdown.

A Touchdown+EP bet is an optional bet that can be placed by any player at any time except on a Kickoff or Extra Point roll. The bet wins and is paid 30 to 1 if two 7s in a row are rolled immediately after placing the bet. Otherwise, the bet is lost.

An any Turnover bet is an optional bet that can be made by any player on any roll except a new shooter's initial roll. If the shooter rolls a Turnover on the next roll, the bet wins and is paid 5 to 1. Otherwise, the bet is lost.

An Any Penalty bet is an optional bet that can be placed by any player at any time. If the shooter rolls either a 5-yard or 10-yard penalty on the next roll, the bet wins and is paid 4 to 1. Otherwise, the bet is lost.

An any 5-yard Penalty bet is an optional bet that can be made by any player on any roll. If the shooter rolls a 5-yard penalty on the next roll, the bet wins and is paid 7 to 1. Otherwise, the bet is lost.

An any 10-yard Penalty bet is an optional bet that can be placed by any player at any time. If the shooter rolls a 10-yard penalty on the next roll, the bet wins and is paid 9 to 1. Otherwise, the bet is lost.

A Place bet is an optional bet that can be made by any player on any roll except a new shooter's initial roll. The bet is placed by the player on a specific number. It cannot be placed on the chosen turnover number. If the shooter rolls that specific number, the bet is paid according to the paytable listed in Table II. If the Turnover number is rolled, the bet is lost.

TABLE II

| Place Bet Number | Pays |
|---|---|
| 2/3 | 9 to 6 |
| 4 | 9 to 6 |
| 5 | 7 to 6 |

TABLE II-continued

| Place Bet Number | Pays |
|---|---|
| 6 | 19 to 20 |
| 8 | 19 to 20 |
| 9 | 7 to 6 |
| 10 | 9 to 6 |

A hardway bet is an optional bet that can be placed by any player at any time other than a new shooter's initial roll. If the shooter rolls the chosen value "hard" before rolling the Turnover value or the corresponding "easy" value, the player is paid according to the paytable listed in Table III Players cannot bet on a hardway if it is the same as the Turnover number.

TABLE III

| Hard Value | Pays |
|---|---|
| 4 | 6 to 1 |
| 6 | 8 to 1 |
| 8 | 8 to 1 |
| 10 | 6 to 1 |

FIG. 1 is a flowchart illustrating an exemplary method for implementing a scrimmage line bet, according to an embodiment.

In operation 100, the player places a scrimmage line bet. This can be placed using chips (real or virtual) on a layout. Any of the other bets described herein can be placed at this point as well.

From operation 100, the method proceeds to operation 101, wherein the shooter rolls the dice (the "kickoff" roll). The shooter is a player who is actually rolling the dice. The game is played with two standard 6-sided dice. Other players who are not the shooter are free to place their own bets on the layout as they please (in accordance with the rules herein).

From operation 101, the method proceeds to operation 102, which determines the outcome of the roll in operation 101. If the roll is a 2 or 3 then the method proceeds to operation 104, wherein the scrimmage line bet is an instant winner and is paid even money. If in operation 102, it is determined that the roll is a 5 or 10, then this is an instant lose and the scrimmage line bet loses in operation 103.

If in operation 102 it is determined that the roll is anything else (4, 6-9, or 11-12) then the method proceeds to operation 107. In operation 107, the shooter chooses a turnover roll (6 or 8) at the shooter's discretion. Note that it is now considered the first down (down 1).

From operation 107, the method proceeds to operation 108 which offers all players the option to lay odds (back the scrimmage line bet). The odds bet will win when the scrimmage line bet wins and will lose with the scrimmage line bet loses.

From operation 108, the method proceeds to operation 109, wherein the shooter rolls the dice again.

From operation 109, the method proceeds to operation 110, which determines the result of the roll in operation 109. If the result is a 7, then the method proceeds to operation 105, which results in a win (touchdown) in which pays the scrimmage line bet is a winner (but the actual payout isn't known yet until the conversion roll). The method then proceeds to operation 106, which implements the conversion roll (which follows to FIG. 2).

If in operation 110 equals the turnover roll (selected by the shooter in operation 107) then the method proceeds to operation 111, which is a "turnover" and the scrimmage line bet loses.

If in operation 110, the roll is not a 7 and is not the turnover roll then the method proceeds to operation 112 which increases the down (e.g., if it was down 1 then now it is down 2).

From operation 112, the method proceeds to operation 113, which determines if it is now past down 4 (e.g., down 5). If not then the method returns to operation 108 where the players have the option to lay odds and the shooter will continue shooting. If in operation 113 it is down 5, then the method proceeds to operation 114, where it becomes down 1 again.

Figure 2:
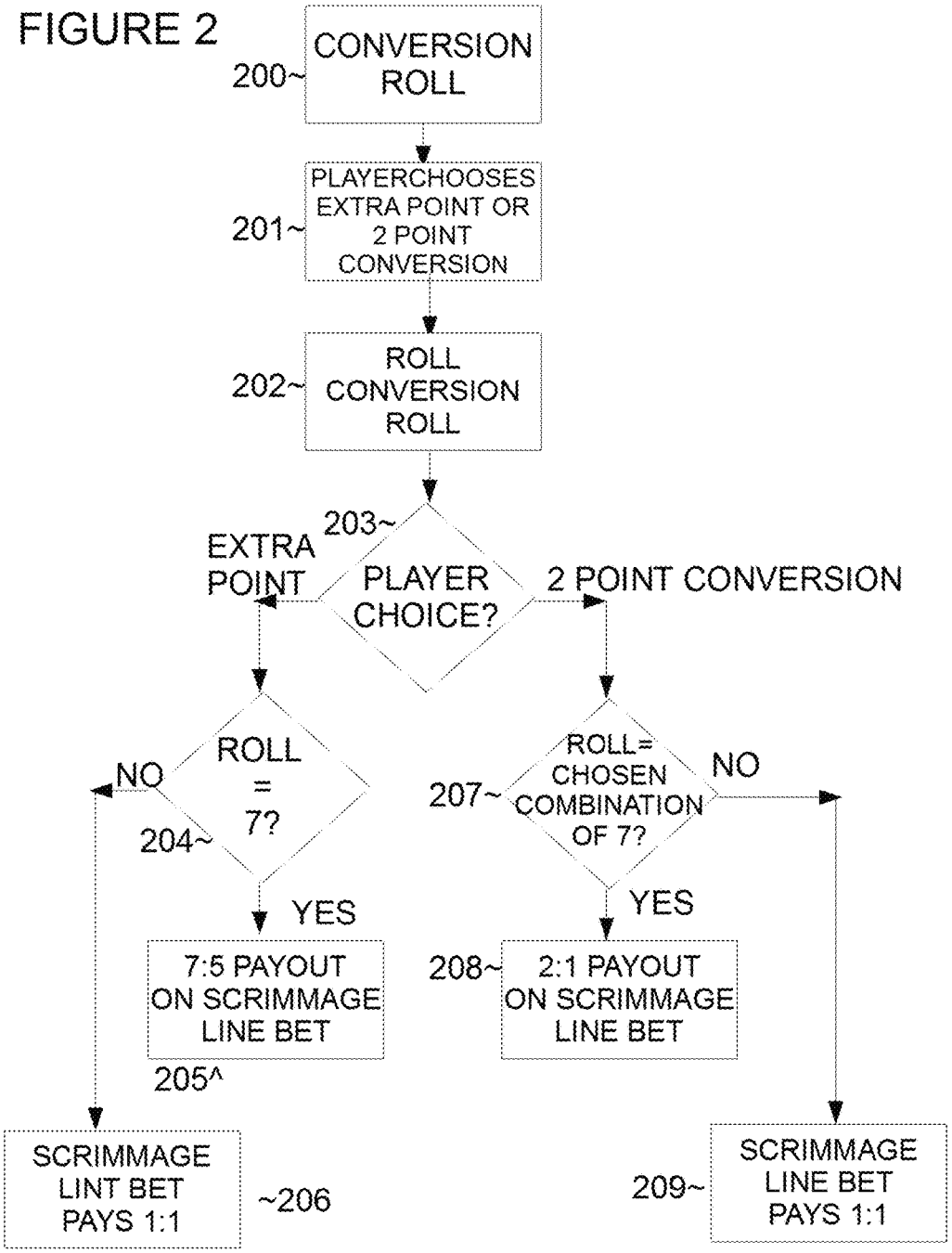
FIG. 2 is a flowchart illustrating an exemplary method for implementing a conversion roll, according to an embodiment.

FIG. 2 is a flowchart illustrating an exemplary method for implementing a conversion roll, according to an embodiment.

In operation 200, the method continues from FIG. 1, operation 106. From operation 200, the method proceeds to operation 201, wherein the shooter chooses to go for an extra point or a two point conversion. If the shooter chooses to go for the 2-point conversion, then the shooter must also choose a particular 7 roll combination (values of two dice that will total 7, e.g. 6+1, 5+2, 4+3).

From operation 201, the method proceeds to operation 202, wherein the shooter rolls the dice in a conversion roll.

From operation 202, the method proceeds to operation 203, which determines whether the shooter (in operation 201) chose to go for the extra point of the two point conversion.

If the shoot (in operation 201) chose to go for the extra point, then the method proceeds to operation 204, which determines if the conversion roll (from operation 202) is a 7. If not, then the method proceeds to operation 206 wherein the scrimmage line bet pays 1:1. If in operation 204, it is determined that the conversion roll (from operation 202) was a 7 then the method proceeds to operation 205 which pays a payout of 7:5 on the scrimmage line bet.

If in operation 203 it is determined that the shoot chose to go for the 2 point conversion, then the method proceeds to operation 207, which determines if the conversion roll (operation 202) matches the chosen combination of 7 (selected by shooter in operation 201). If not, then the method proceeds to operation 209, which pays the scrimmage line bet 1:1.

If in operation 207, it is determined that the conversion roll (operation 202) matches the chosen combination of 7 (selected by the shooter in operation 201), then the method proceeds to operation 208, which pays a 2:1 payout on the scrimmage line bet.

Note that Shooters change only when a Turnover is completed, so even if the shooter rolls numerous 5- and 10-yard penalties on the kickoff roll, he/she still gets to roll. In the case of the super bet, the shooter will keep shooting even if he/she hits 4 TDs+4 EPs. Once the super bet loses, the shooter will change (since the super bet loses on a turnover).

Figure 3:
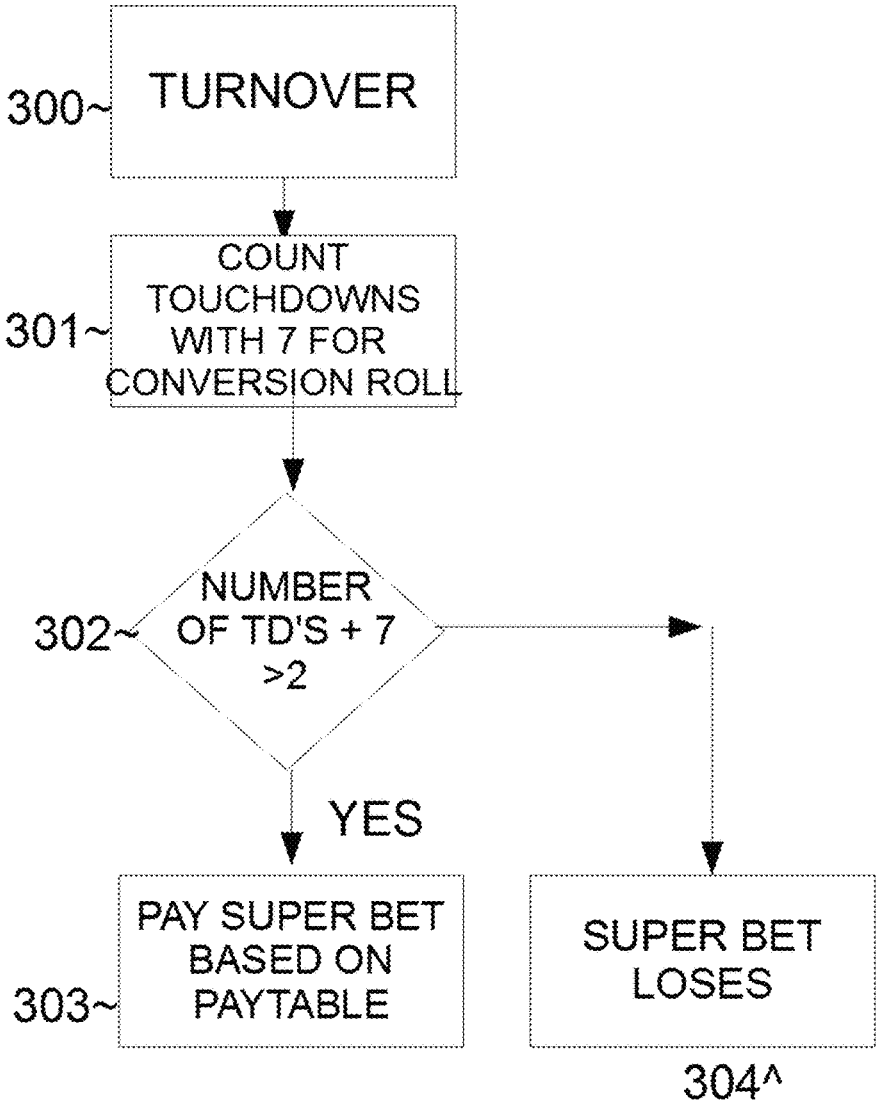
FIG. 3 is a flowchart illustrating an exemplary method for implementing a super bet, according to an embodiment.

FIG. 3 is a flowchart illustrating an exemplary method for implementing a super bet, according to an embodiment. The super bet is a side bet that can be placed at operation 100 (along with any other of the bets).

Once there is a turnover in operation 300 (operation 111 from FIG. 1 occurs), then the method proceeds to operation 301, which counts the touchdowns which resulted in a 7 for the conversion roll (it does not matter whether the extra point or the two point conversion was selected.

From operation 301, the method proceeds to operation 302, which determines whether the number of touchdowns with the 7 for the conversion roll is greater than 2. If not, then the method proceeds to operation 304 wherein the super bet loses.

If in operation 302, the number of touchdowns with the 7 for the conversion roll is greater than 2, then the method proceeds to operation 303, which pays the super bet based on a paytable. The paytable can be, for example, Table IV below (although of course other paytables can be used). Note the super bet is only paid once, once it the turnover has occurred and it is determined how many touchdowns+7 have occurred (since the game began in operation 100).

TABLE IV

| Touchdowns + 7 | Payout |
|---|---|
| 0 | −1 (lose) |
| 1 | −1 (lose) |
| 2 | −1 (lose) |
| 3 | 70 for 1 |
| 4 | 700 for 1 |

Note that the super but does not lose on kickoff rolls or conversion rolls and can only loses on a turnover. The super bet can only be bet before a new shooter rolls. The super bet is required for the shooter and can be optional for other players.

Another bet the can be offered is the first down bet. If the shooter makes it through the first, second, third, and fourth down without a touchdown or a turnover, then the first down bet wins 7:5 (or other payout). The first down bet does not lose on kickoff or conversion rolls. The first down bet only loses on a turnover and pushes on a touchdown. The first down bet is required when betting the scrimmage line, cannot be taken down, and can only be increased prior to any first down roll. The first down bet can be bet independently and can be removed if not betting the scrimmage line bet. The first down bet can keep winning over and over for all 1$^{st}$ (first) downs that the shooter earns (after the fourth down the down returns again to the first down).

Another bet offered is the defense bet, which on the kickoff roll would immediately lose on a 2 or 3, push on a 5, and wins (3:2) on a 10. After the kickoff, the defense bet would win even money on a turnover and lose on a touchdown. Free odds can also be placed which pays 6:5. The free odds bet can be made for both the scrimmage line bet and the defense bet and can be made and removed at any point after the kickoff roll.

Additional bets can be: a touchdown+7 bet which pays only when back to back 7's are rolled on the subsequent two rolls (can be bet anytime except cannot be bet on kickoff rolls and conversion rolls). An any score bet wins of a safety (2) field goal (3) or touchdown (7) is rolled (it is a one roll bet). An any turnover bet wins if a turnover is rolled on the next roll (one roll bet). An any penalty bet wins if a 5 or 10 is rolled on the next roll (one roll bet).

Additional bets that can be offered are place bets (against the turnover number), lay bets (against the turnover number), hardways (against easy combinations and the turnover number), field, hop bets, prop bets, etc.

In a further embodiment, an additional wager known as a sideline wager can be implemented.

Figure 4:
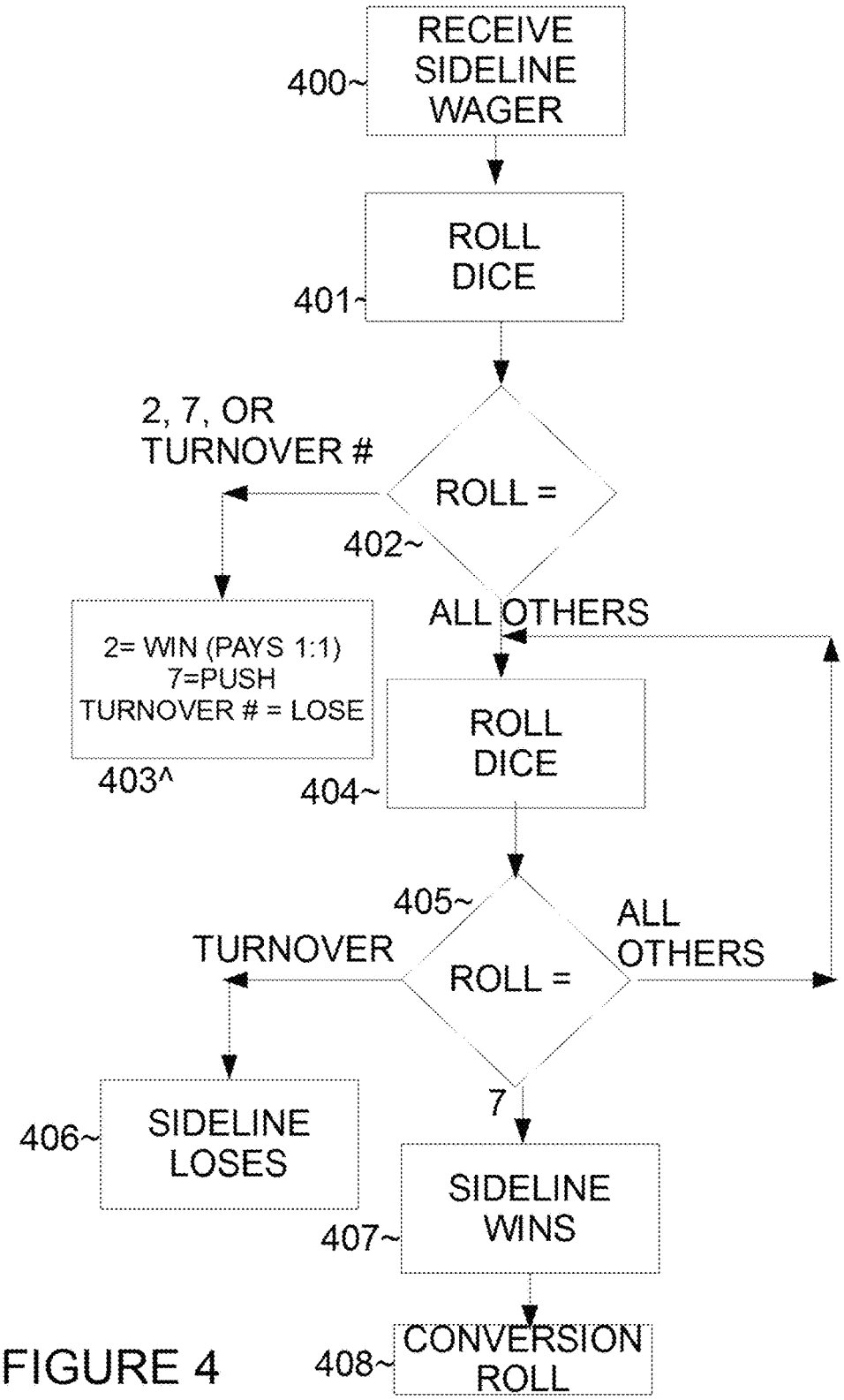
FIG. 4 is a flowchart illustrating an exemplary method for implementing a sideline bet, according to an embodiment.

FIG. 4 is a flowchart illustrating an exemplary method for implementing a sideline bet, according to an embodiment.

The sideline wager can be made at any time except on a kickoff roll or a conversion roll. The sideline wager is received from the player in operation 400.

From operation 400, the method proceeds to operation 401, which rolls the dice.

From operation 401, the method proceeds to operation 402, which compares the last roll to predetermined numbers. If the roll is a 2, 7 or matches the turnover number (from operation 107), then the method proceeds to operation 403.

In operation 403, if the roll is a 2 then the sideline wager wins (pays 1:1). If the roll is a 7 then the sideline wager pushes (neither wins nor loses). If the roll matches the turnover roll then the sideline wager loses.

If in operation 402 the roll is anything else (not in the set of 2, 7 and the turnover number), then the method proceeds to operation 404 wherein the dice are rolled.

From operation 404, the method proceeds to operation 405, wherein compares the last roll to predetermined numbers. If the roll matches the turnover number, then the method proceeds to operation 406 and the sideline wager loses.

If in operation 405 the roll is a 7 then the method proceeds to operation 407 and the sideline wager wins (the payout is not yet known). Then the method proceeds to operation 408 which initiates a conversion roll in order to determine the payout on the winning sideline wager. The conversion roll is implemented as illustrated in FIG. 2. Once the player is paid after the conversion roll, the play will start over with a new kickoff roll (return to operation 100).

In operation 405, if the last roll is not in the set of (7 and turnover) then the method returns to operation 404 which rolls the dice again.

Figure 5:
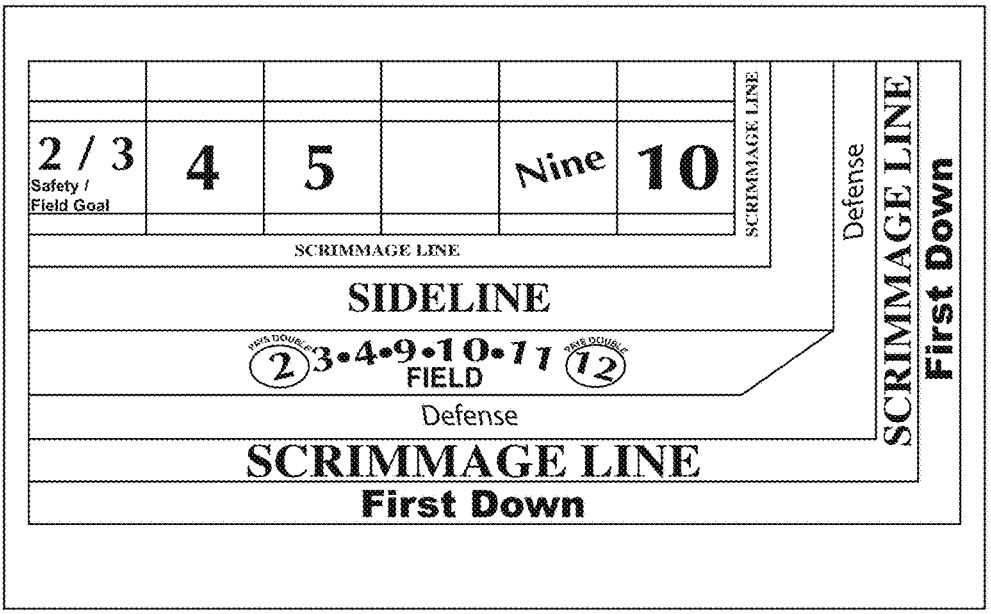
FIG. 5 shows an exemplary layout that can be used to receive bets from the player, according to an embodiment.

FIG. 5 is a drawing of an example of a betting layout, according to an embodiment.

FIG. 5 shows an exemplary layout that can be used to receive bets from the player. The layout can be virtual (e.g., displaying on an electronic display) or can be printed on a felt for receiving physical chips placed by the player(s). The player would place his chips (real or virtual) on the respective betting areas. After the bets are resolved, winning bets are paid and losing bets are taken.

Note that the numbers "2/3", "4", "5", "blank", "nine", and "10" are shown which can be used for place bets. Inside the blank box can be placed a special puck which has "6" on one side and "8" on the other side. If the shooter chooses "8" to be the turnover number, then the base dealer will put the puck in the blank box with the "6" showing, and players will be able to place the "6". On the other hand, if the shooter chooses "6" to be the turnover number, then the dealer will put the puck in the blank box with the "8" showing, and players will be able to place the "8."

Figure 6:
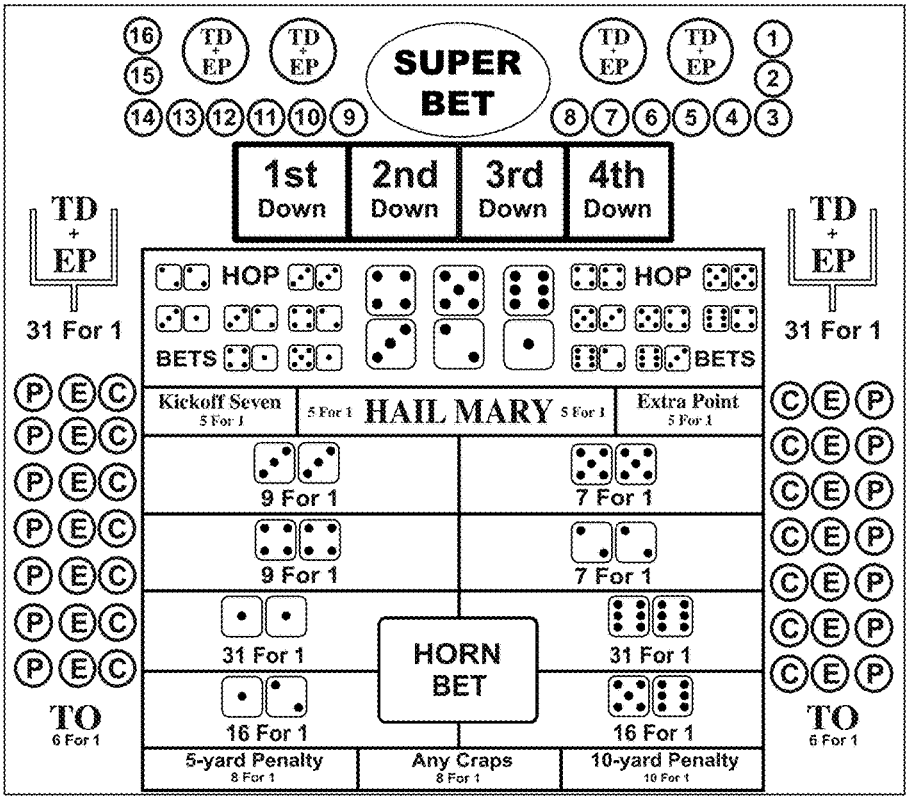
FIG. 6 shows an exemplary layout that can be used to receive prop bets from the player, according to an embodiment.

FIG. 6 shows an exemplary layout that can be used to receive prop bets from the player. The layout in FIG. 6 can be used in conjunction with the layout illustrated in FIG. 5. The layout can be virtual (e.g., displaying on an electronic display) or can be printed on a felt for receiving physical chips placed by the player(s).

The 1-16 circles are where each player's super bet will be placed, each circle is for each player so that each player's bet can be tracked. The C & E circles are the standard craps & eleven bets, and the "P" circles are for betting on a penalty. (If the shooter rolls a 5 or 10 on the very next roll, then the penalty bet wins. The "TD+EP" circles indicate how many touchdowns+extra points the shooter has scored (in order to keep track for the Super Bet). The 1st down, 2nd down, etc. boxes are to indicate which down it is (a puck or lamer can be used to mark the respective down. In the electronic version, the respective down can light up or be highlighted). The TD+EP bet (in the goal post) is a bet that wins when the shooter rolls back-to-back sevens on the next 2 rolls. The TO bet is a one roll bet that wins when the shooter rolls the turnover number. The hail mary, extra point, and kickoff seven are alternate names for an any seven bet (which pays when the next roll totals seven and loses if the next roll is does not total seven).

Note that in any layout used, in the electronic version, virtual dice can be rolled which animates and display a randomly selected number on each die using an electronic random number generator. The virtual dice would appear like real dice (six sides numbered one through six). Note that the layouts show are just exemplary and any area can be optional. It can be appreciated that the methods described herein can be implemented using other layouts as well.

Each of the circles is where each player can place their super bet. The ovals numbered 1 through 4 would be used to indicate how many touchdowns have been scored with the seven for the conversion roll. In the physical version, the layout would be on a table and a light can be embedded under the table to light up the respective oval (or a physical marker such as a puck can be used). In the virtual version, the ovals would light up.

Figure 7A:
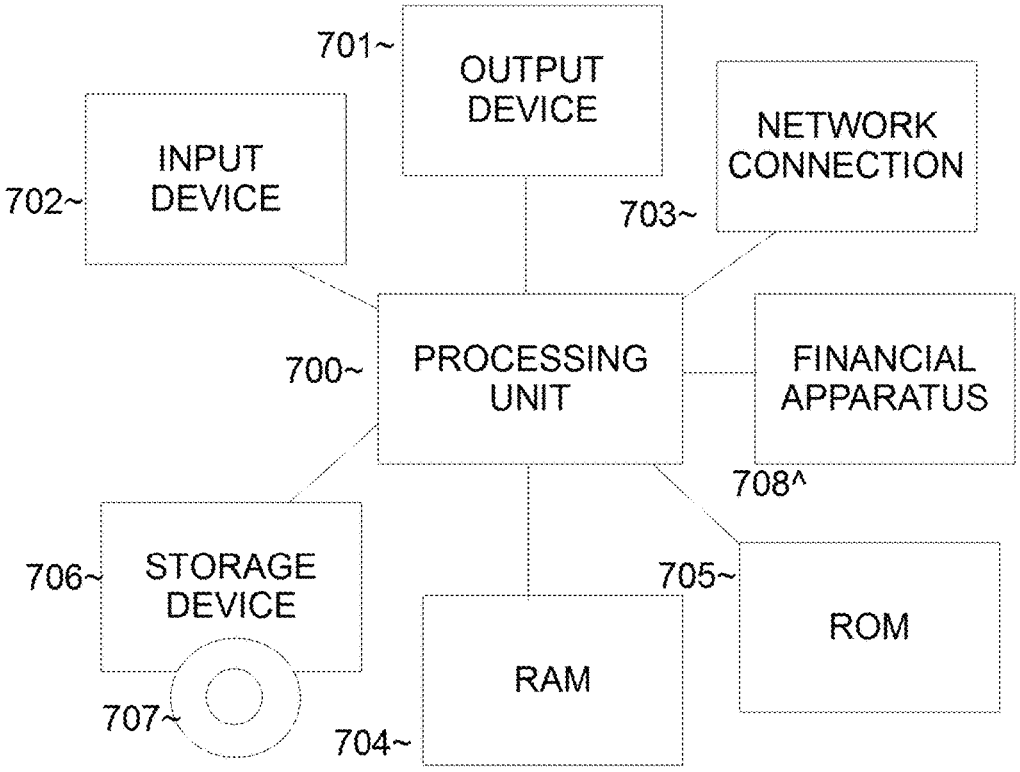
FIG. 7A is a block diagram illustrating hardware that can be used to implement electronic versions of the wagering methods described herein, according to an embodiment.

FIG. 7A is a block diagram illustrating exemplary hardware that can be used to implement the game described herein, according to an embodiment. The hardware in FIG. 7A can be used to implement a computer implementing the game described herein and/or a server that is serving the game to a computer which is displaying the game to a player.

A processing unit 700 can be a microprocessor and associated structure (e.g., bus, cache, clock, etc.) which can be connected to an input device (e.g., touch-screen, keyboard, mouse, buttons, etc.) which can receive any input described herein or otherwise, and an output device (e.g., touch-screen, CRT, monitor, etc.) which can display any output, result, change of state, etc. The processing unit 700 can also be connected to a network connection 703 which can connect to a computer communications network such as the Internet, Wi-Fi, LAN, WAN, etc. The processing unit 700 can also be connected to a ROM 704 and a RAM 705 as used in the art. The processing unit 700 can also be connected to a storage device 706 which can be nonvolatile storage device (e.g., BLU-RAY drive, CD-ROM drive, hard drive, EPROM, etc.) A computer readable medium 707 (e.g., BLU-RAY disc, CD-ROM, hard disc, etc.) can be read by the storage device 706 and can store programs and assets that can cause the processing unit 700 to perform any of the methods described herein. The ROM 704 and RAM 705 can also be loaded with instructions that can cause the processing unit 700 to perform any of the methods described herein.

The processing unit 700 can also be connected to a payment validator 708. The payment validator can be a bill acceptor which accepts currency, identifies it as being valid (typically by using an optical scanner), and then credits the inserted bill amount to the machine (for example inserting a $10 bill will credit the machine with $10 in credits). The bill acceptor can also accept cashless tickets as part of a 'ticket-in-ticket-out" system, in which tickets (cashless vouchers) have cash value and can be inserted into the payment validator 708. The validator 708 validates the ticket (typically be optically scanning a bar-code) and crediting the machine with the respective amount of credits. The payment validator 708 can also include a card reader which can read cards (e.g., with a magnetic stripe or other electronic encoding) so that an account number can be accessed. The cards can be a credit card, player loyalty card, specific casino payment card, or any card that can provide electronic access to a monetary amount owned by the player (owner of the card) which the player can utilize for playing the slot machine. If such a card is used, then the player can optionally enter (using a keypad) an amount the player wishes to withdraw from the account associated with the card to credit to the slot machine.

The processing unit 700 can also be connected to a ticket printer 709 which can print tickets (cashless vouchers). When the player cashes out on the slot machine (indicated to the machine that the player wishes to cash out and terminate by, typically by pressing a button), a ticket is printed by the ticket printer 709 which carries the amount of credits left on the machine. This ticket can then be used to play other machines in the casino by inserting them into that machine's payment validator. The ticket can also be used to redeem for cash by inserting it into a ticket redemption machine (kiosk) which receives a ticket, validates it (typically by scanning the barcode), and then dispenses an identical amount of cash to what the ticket's value is.

Figure 7B:
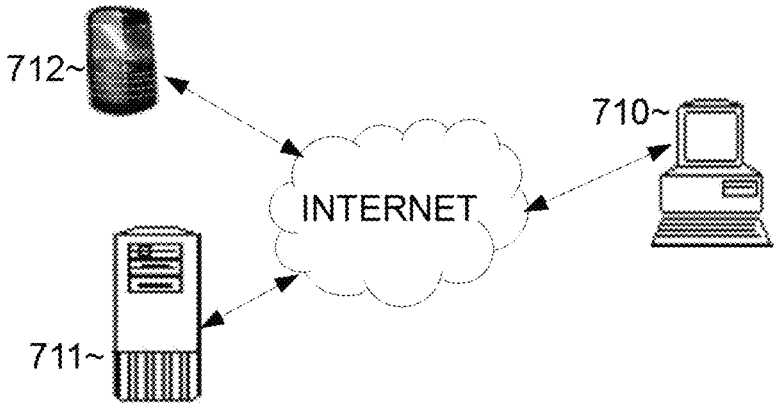
FIG. 7B is a block diagram illustrating an exemplary network configuration to implement a player playing an online version of the methods described herein.

FIG. 7B is a network diagram showing a network structure for a social networking web site and players, according to an embodiment. The online game which awards and stores virtual points can also be accomplished by the system illustrated in FIG. 7B.

A computer communications network (such as the Internet) can be used to connect a host server 710 which can host and serve a social networking site. Note that while FIG. 7B shows only one server as the host server 710, the host server 710 can encompass numerous servers all cooperating with each other (whether in the same physical location or not). The host server 710 communicates with players 711, 712, 713 through the Internet (or other computer communication network) and can implement any of the methods herein by executing computer code programmed accordingly. Game server 714 can also implement all games and methods described herein on the site by executing computer code programmed accordingly. The game server 714 is connected to the Internet and can communicate with all of the players 711, 712, 713 directly or indirectly through the social networking site hosted by the host server 710. The game server 714 can cooperate with the host server 710 so that the games run on the game server 714 can be integrated into the social networking site hosted by the host server 710. The game server can also be optional and all of the games can be also hosted on the host server 710, whereby the integration of the games served/hosted by the game server 714 will appear embedded in the social networking site hosted by the host server 710 such that players would typically not realize (or care) that multiple servers are cooperating in order to play games on the social networking site. All of the communications described herein can be effectuated using such a network configuration. Typically, the communications are effectuated on the social networking site itself, thus the players 711, 712, 713 should be logged into the social networking site in order to participate herein, although logging in is not required (e.g., communications can be transmitted using other methods, such as email, IRC chat, instant message, etc.) The host server 710 can communicate with any of the devices illustrated in FIG. 3.

All components herein can be distributed across different such components as needed. For example, a single server as mentioned herein can be distributed across numerous different servers and locations. A processor (or processing unit) can also be distributed across multiple processors in a same or different computer (at a same or different location). The electronic components described herein represent an abstraction but it can be appreciated that the computer systems implementing the methods herein can be more numerous and interconnected than illustrated herein.

If a player is playing the game described herein on a social networking site or other type of hosted environment, then the player's computer would cooperate with the social networking server in order to present the game to the player. The player's computer would perform the instructions necessary to display the game while the remote server can determine the results (e.g., the final arrangement) and communicate this result via the Internet to the player's computer so that the player's computer can accurately display the result. The remote server may track and account for all credits wagered and won/lost while the player's computer can display the amount of credits owned or won at the direction of the remote server so the player cannot tamper with these amounts. All games described herein are considered to be played on the site described herein.

Note that all payouts herein are merely examples and any set of payouts can be used. In addition, while the roll numbers identified here are one set of winning and losing outcomes on the dice, it can be appreciated that the game can be modified so that other roll numbers can be used as well (e.g., instead of a 7 winning a touchdown in operation 110, an 8 can be a touchdown). Note that the words "bet" and "wager" are used herein synonymously.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a (non-transitory) computer readable storage medium to control a computer. Programs and/or data required to implement any of the methods/features described herein can all be stored (and executed therefrom to perform any of the methods/features) on any non-transitory computer readable storage medium (volatile or non-volatile, such as CD-ROM, RAM, ROM, EPROM, microprocessor cache, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement an interactive wagering protocol, the method comprising:

providing an electronic input device, an output device and an electronic processor;

executing computer readable instructions on the electronic processor thereby causing the following operations to occur:

receiving a first wager from a player;

generating a first random number using one or more electronic random number generators;

providing a three sets of first outcomes, a first set of first outcomes resulting in a win of the first wager, a second set of first outcomes resulting in a loss of the wager, and a third set of first outcomes resulting in continued play, wherein the first set of first outcomes is triggered when the first random number is in a first set first random number outcomes, the second set of first outcomes is triggered when the first random number is in a second set of first random number outcomes, and the third set of first outcomes is triggered when the first random number is in a third set of first random number outcomes;

determining that the first random number falls into the third set of outcomes;

receiving a choice of turnover roll from the player which is a potential outcome of a second random number;

receiving an odds wager from the player;

generating the second random number using the one or more electronic random number generators; and providing three sets of second outcomes, a first set of second outcomes resulting in a win of the first wager, a second set of second outcomes being the choice of turnover rolls which results in a loss of the first wager, and a third set of second outcomes being all other potential outcomes which continues play.

2. The method as recited in claim 1, further comprising:

determining that the second random number falls into the third set of second outcomes;

increasing a down; and returning to the receiving an odds wager from the player.

3. The method as recited in claim 1, wherein if the second random number falls in the first set of second outcomes, then implementing a conversion roll by:

receiving a choice from the player to choose from a choice set comprising an extra point and a two point conversion;

generating a third random number using the one or more random number generators.

4. The method as recited in claim 1, further comprising receiving a superbet alongside the first wager, and providing that when the second random number matches the choice of turnover roll, then initiating a turnover sequence.

5. The method as recited in claim 4, wherein the turnover sequence comprises if a number of touchdowns with a predefined conversion roll is greater than a particular threshold then the superbet wins otherwise the superbet does not win.

6. The method as recited in claim 5, wherein the particular threshold is 1.

7. The method as recited in claim 1, further comprising:

determining that the second random number falls into the first set of second outcomes;

receiving a play choice by the player out of a set comprising 1) extra point and 2) conversion;

generating a conversion roll which is a random number using the one or more random number generators; and paying a payout on the first wager based on the conversion roll.

8. The method as recited in claim 7, further comprising providing rules that if the play choice is the extra point and the conversion roll equals a particular point total then the payout on the first wager is a higher amount than if the conversion roll does not equal the particular point total.

9. The method as recited in claim 8, further comprising providing rules that if the play choice is the conversion and the conversion roll matches a predetermined selection of values selected by the player then the payout on the first wager is a higher amount than if the conversion roll does not match the predetermined selection of values selected by the player.

10. The method as recited in claim 9, wherein the payout on the first wager when the player choice is the conversion and the conversion roll matches the predetermined selection of values is higher than if the player choice is the extra point and the conversion rolls equals the particular point total.

11. An apparatus to implement an interactive wagering protocol, the apparatus comprising:

an electronic input device, an electronic output device;

at least one electronic processor connected to the input device and the output device and configured to read computer readable instructions from a memory and execute the computer readable instructions, the computer readable instructions being programmed to cause the at least one electronic processor to:

receive a first wager from a player;

generate a first random number using one or more electronic random number generators;

provide a three sets of first outcomes, a first set of first outcomes resulting in a win of the first wager, a second set of first outcomes resulting in a loss of the wager, and a third set of first outcomes resulting in continued play, wherein the first set of first outcomes is triggered when the first random number is in a first set of first random number outcomes, the second set of first outcomes is triggered when the first random number is in a second set of first random number outcomes, and the third set of first outcomes is triggered when the first random number is in a third set of first random number outcomes;

determine that the first random number falls into the third set of outcomes;

receive a choice of turnover roll from the player which is a potential outcome of a second random number;

receive an odds wager from the player;

generate the second random number using the one or more electronic random number generators; and provide three sets of second outcomes, a first set of second outcomes resulting in a win of the first wager, a second set of second outcomes being the choice of turnover rolls which results in a loss of the first wager, and a third set of second outcomes being all other potential outcomes which continues play.

12. The apparatus as recited in claim 11, wherein the computer readable instructions are further programmed to cause the at least one electronic processor to:

determine that the second random number falls into the third set of second outcomes;

increase a down; and return to the receive an odds wager from the player.

13. The apparatus as recited in claim 11, wherein the computer readable instructions are further programmed to cause the at least one electronic processor to:

if the second random number falls in the first set of second outcomes, then implementing a conversion roll by:

receive a choice from the player to choose from a choice set comprising an extra point and a two point conversion;

generate a third random number using the one or more random number generators.

14. The apparatus as recited in claim 11, wherein the computer readable instructions are further programmed to cause the at least one electronic processor to:

receive a superbet alongside the first wager, and providing that when the second random number matches the choice of turnover roll, then initiating a turnover sequence.

15. The apparatus as recited in claim 14, wherein the computer readable instructions are further programmed to cause the at least one electronic processor to implement:

wherein the turnover sequence comprises if a number of touchdowns with a predefined conversion roll is greater than a particular threshold then the superbet wins otherwise the superbet does not win.

16. The apparatus as recited in claim 15, wherein the computer readable instructions are further programmed to cause the at least one electronic processor to implement that the particular threshold is 1.

17. The apparatus as recited in claim 11, wherein the computer readable instructions are further programmed to cause the at least one electronic processor to:

determine that the second random number falls into the first set of second outcomes;

receive a play choice by the player out of a set comprising 1) extra point and 2) conversion;

generate a conversion roll which is a random number using the one or more random number generators; and pay a payout on the first wager based on the conversion roll.

18. The apparatus as recited in claim 17, wherein the computer readable instructions are further programmed to cause the at least one electronic processor to:

provide rules that if the play choice is the extra point and the conversion roll equals a particular point total then the payout on the first wager is a higher amount than if the conversion roll does not equal the particular point total.

19. The apparatus as recited in claim 18, wherein the computer readable instructions are further programmed to cause the at least one electronic processor to:

provide rules that if the play choice is the conversion and the conversion roll matches a predetermined selection of values selected by the player then the payout on the first wager is a higher amount than if the conversion roll does not match the predetermined selection of values selected by the player.

20. The apparatus as recited in claim 19, wherein the computer readable instructions are further programmed to cause the at least one electronic processor to implement wherein the payout on the first wager when the player choice is the conversion and the conversion roll matches the predetermined selection of values is higher than if the player choice is the extra point and the conversion rolls equals the particular point total.

21. An apparatus to implement an interactive wagering protocol, the apparatus comprising:

an electronic input device, an electronic output device;

at least one electronic processor connected to the input device and the output device and configured to read computer readable instructions from a memory and execute the computer readable instructions, the computer readable instructions being programmed to cause the at least one electronic processor to:

receive a first wager from a player;

generate a first random number using one or more electronic random number generators;

provide a three sets of first outcomes, a first set of first outcomes resulting in a win of the first wager, a second set of first outcomes resulting in a loss of the wager, and a third set of first outcomes resulting in continued play, wherein the first set of first outcomes is triggered when the first random number is in a first set of first random number outcomes, the second set of first outcomes is triggered when the first random number is in a second set of first random number outcomes, and the third set of first outcomes is triggered when the first random number is in a third set of first random number outcomes;

wherein when the first random number falls is in the third set of first random number outcomes, then: receiving a choice of turnover roll from the player; receiving an odds wager from the player; generating a second random number using the one or more electronic random number generators; and providing three sets of second outcomes, a first set of second outcomes resulting in a win of the first wager, a second set of second outcomes being the choice of turnover rolls which results in a loss of the first wager, and a third set of second outcomes being all other potential outcomes which continues play, wherein the first set of second outcomes is triggered when the second random number is in a first set of second number outcomes, the second set of second outcomes is triggered when the second random number is in a second set of second number outcomes which is the choice of turnover rolls, and the third set of second outcomes is triggered when the second random number is in a third set of second number outcomes.

* * * * *